US008047869B2

(12) United States Patent
Chuang

(10) Patent No.: US 8,047,869 B2
(45) Date of Patent: Nov. 1, 2011

(54) MULTI-PORT CONNECTOR WITH DIFFERENT STANDARDS

(76) Inventor: Yi-Fang Chuang, Sanchong (TW)

( * ) Notice: Subject to any disclaimer, the term of this patent is extended or adjusted under 35 U.S.C. 154(b) by 0 days.

(21) Appl. No.: 12/400,307

(22) Filed: Mar. 9, 2009

(65) Prior Publication Data

US 2009/0305557 A1 Dec. 10, 2009

(30) Foreign Application Priority Data

Jun. 4, 2008 (TW) ..... 97209859 U

(51) Int. Cl.
*H01R 13/60* (2006.01)

(52) U.S. Cl. ..... 439/541.5; 439/607.01

(58) Field of Classification Search ..... 439/541.5, 439/607.01

See application file for complete search history.

(56) References Cited

U.S. PATENT DOCUMENTS 6,368,150 B1 * 4/2002 Zheng et al. ..... 439/541.5
6,835,092 B2 * 12/2004 Wan et al. ..... 439/541.5
7,192,198 B1 * 3/2007 Chen et al. ..... 385/76
7,273,391 B2 * 9/2007 Purwin ..... 439/502
7,320,618 B2 * 1/2008 Tsai ..... 439/541.5
7,364,463 B1 * 4/2008 Ju ..... 439/607.55
7,410,391 B2 * 8/2008 Wan et al. ..... 439/607.01
7,473,136 B2 * 1/2009 Hu et al. ..... 439/607.01
7,611,380 B2 * 11/2009 Yuan ..... 439/541.5
2007/0232132 A1 * 10/2007 Ling et al. ..... 439/541.5

* cited by examiner

*Primary Examiner* — Truc Nguyen

(74) *Attorney, Agent, or Firm* — Chun-Ming Shih; HDLS IPR Services

(57) ABSTRACT

A multi-port connector of different standards is electrically connected on a circuit board of an electronic device and includes a base, a High Definition Multimedia (HDMI) connector and a SPDIF connector. The base has a first mounting space and a second mounting space. The HDMI connector is mounted in the first mounting space. The HDMI connector is provided with conductive pins extending to the outside of the base. The SPDIF connector has a housing that is mounted in the second mounting space. The interior of the housing has a light receiver. The pins of the light receiver extend to the outside of the base.

3 Claims, 8 Drawing Sheets

MULTI-PORT CONNECTOR WITH DIFFERENT STANDARDS

BACKGROUND OF THE INVENTION

1. Field of the Invention

The present invention relates to a connector, and in particular to a multi-port connector.

2. Description of Prior Art

SPDIF is the abbreviation of Sony/Philips Digital Interface and may be also written as S/PDIF. It is an interface for transmitting digital signals, such as PCM, AC3, DTS or other similar signals. In order to enhance the transmission of digital audio signals, such a SPDIF connector utilizes double phase coding technology in left and right sound channels as well as the mixing of sample frequency into the transmitted digital signals, thereby generating a superior definition (bytes) up to 24 bytes. Further, in cooperation with a high-speed transmission medium such as optical fiber, the accuracy and synchronicity of data can be achieved.

Furthermore, High Definition Multimedia (HMDI) audio/video transmission interface can provide a data transmission bandwidth up to 5 Gbps as well as transmit non-compressed audio signals and high-definition video signals without A/D or D/A conversion before transmitting signals. Thus, HDMI can guarantee the highest quality of transmitting audio/video signals.

When using these two connectors of different standards, both of them are electrically connected to the circuit board of an electronic device separately. Since the electronic device is designed to be more and more compact, is not easy to connect a HDMI connector and a SPDIF connector on the same circuit board because of the spatial restriction of reduced volume of the circuit board. Alternatively, one of the HDMI connector and the SPDIF connector may be sacrificed. Thus, it is an important issue to electrically connect two connectors of different standards to the same circuit board without occupying the space of the circuit board or sacrificing a certain connector.

SUMMARY OF THE INVENTION

The present invention is to overlap or juxtapose connectors of different standards together to form a multi-port connector. Even on a circuit board with reduced volume or limited space, the connectors of different standards can be electrically connected thereto.

The present invention provides a multi-port connector with different standards, which includes a base, a HDMI connector and a SPDIF connector. The base has a first mounting space and a second mounting space. A partition is provided between the first and second mounting spaces. The partition is provided thereon with a plurality of grooves. Both side wall faces of the second mounting space have two corresponding strip-like or sheet-like insertion portions. The bottom plate of the second mounting space is provided with a plurality of passages. The HDMI connector is mounted in the first mounting space. The HMDI connector is provided with conductive pins disposed in the grooves. The SPDIF connector has a housing that is mounted in the second mounting space. The interior of the housing has a light receiver. The conductive pins of the light receiver are disposed in the passages of the bottom plate.

DETAILED DESCRIPTION OF THE INVENTION

The characteristics and technical contents of the present invention will be explained with reference to the accompanying drawings. However, the drawings are illustrative only but not used to limit the present invention.

Figure 1:
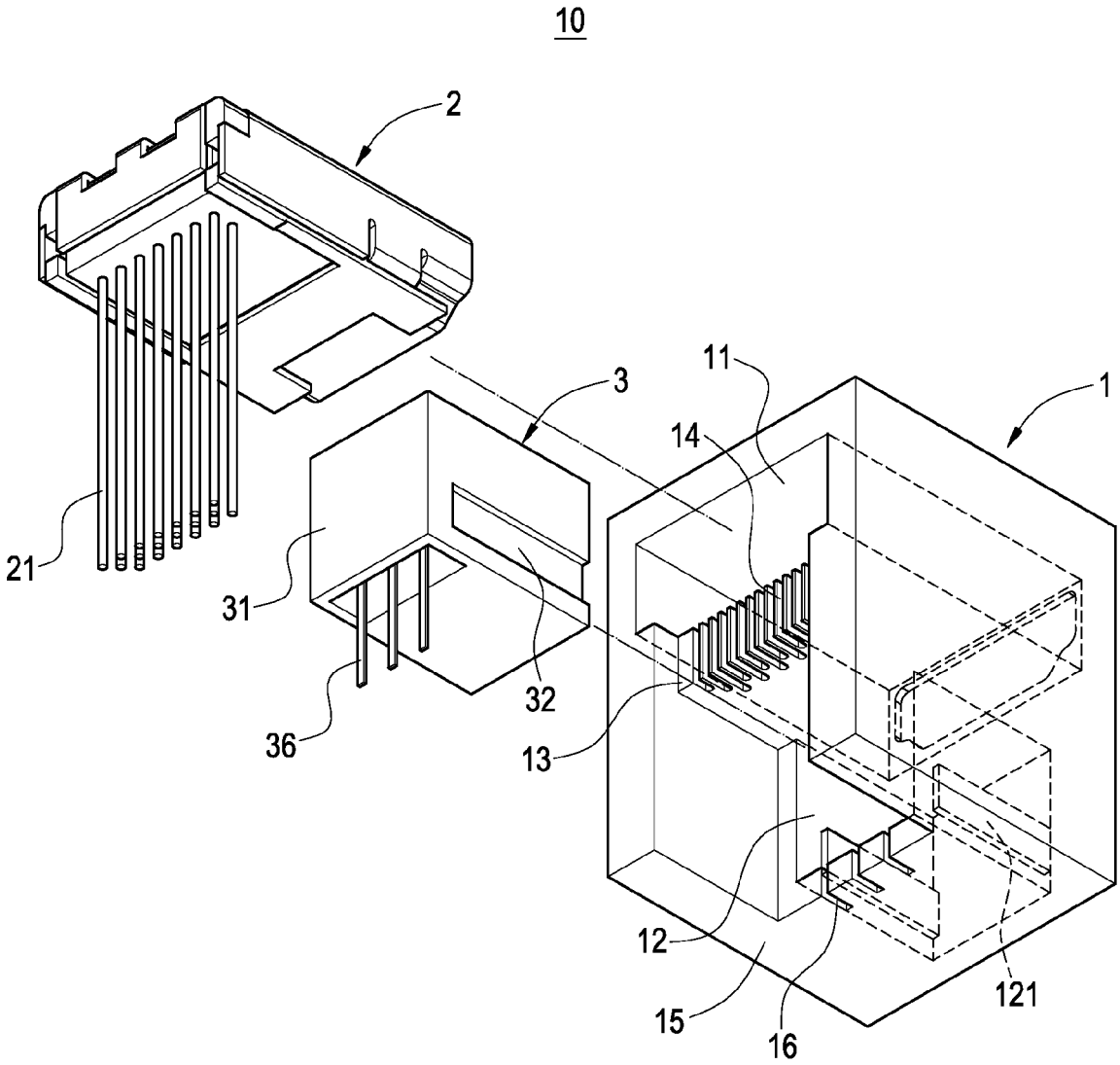
FIG. 1 is an exploded view showing the structure of the multi-port connector according to the present invention.
Figure 2:
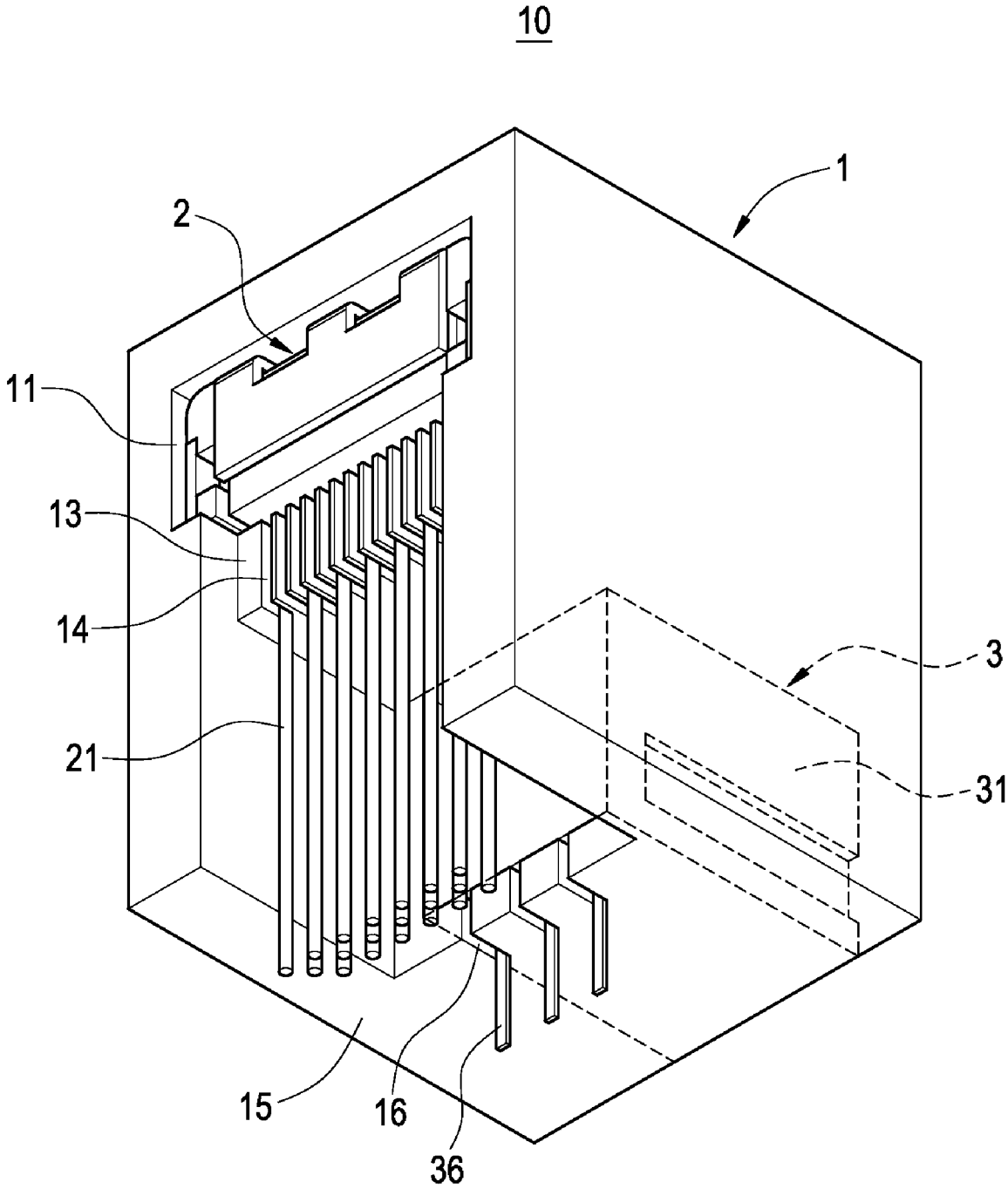
FIG. 2 is an assembled perspective view showing the structure of the multi-port connector according to the present invention.
Figure 3:
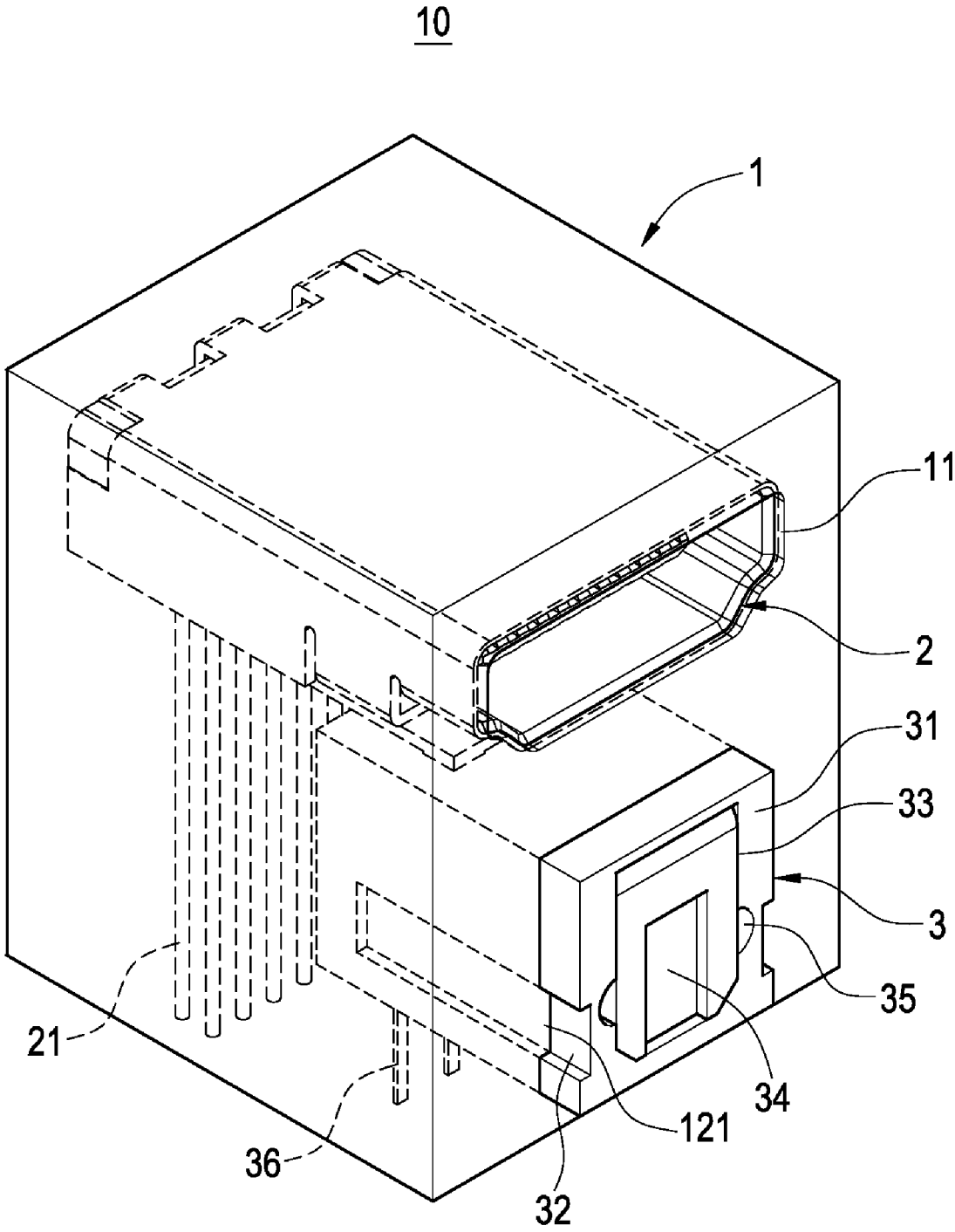
FIG. 3 is another assembled perspective view showing the structure of the multi-port connector according to the present invention.

Please refer to FIGS. 1 to 3. FIG. 1 is an exploded view showing the structure of the multi-port connector according to the present invention. FIG. 2 is an assembled perspective view showing the structure of the multi-port connector according to the present invention. FIG. 3 is another assembled perspective view showing the structure of the multi-port connector according to the present invention. As shown in these figures, the multi-port connector of different standards according to the present invention includes a base 1, a HDMI connector 2 and a SPDIF connector 3.

The base 1 is made of insulating materials and is provided thereon with a first mounting space 11 and a second mounting space 12. Both the first and second mounting spaces penetrate the base 1. The first mounting space 11 allows the HDMI connector 2 to be mounted therein. A partition 13 is provided between the first mounting space 11 and the second mounting space 12. The partition 13 is provided with a plurality of grooves 14. The grooves 14 allow conductive pins 21 of the HDMI connector 2 to pass through and extend to the outside below the base 1. Both side wall faces of the second mounting space 12 have two corresponding strip-like and sheet-like insertion portions 121. The insertion portion 121 allows the SPDIF connector 3 to be lodged therein. A bottom plate 15 of the second mounting space 12 has a plurality of passages 16. The passages 16 allow conductive pins 36 of the SPDIF connector 3 to pass through.

The HDMI connector 2 is of a conventional structure and thus the description thereof is omitted. The bottom of the HDMI connector 2 has a plurality of conductive pins 21. When the HDMI connector 2 is mounted in the first mounting space 11, the conductive pins 21 of the HDMI connector 2 extend from the grooves 14 through the partition 13 to the outside below the base 1.

The SPDIF connector 3 is an optical SPDIF connector and a housing 31 thereon. The housing 31 is mounted in the second mounting space 12. The front end of the housing 31 partially extends to the outside of the second mounting space 12. Both sides of the outer surface of the housing 31 are provided with troughs 32 that are inserted by the insertion portions 121. The interior of the housing 31 has an insertion hole 33. The insertion hole 33 is pivotally connected to a movable shutter 34. After the shutter 34 is pushed away, a plug (not shown) of an optical fiber cable can be inserted into the insertion hole 33. Further, insertion stripes on both sides of the plug of the optical fiber cable are inserted into guiding rails 35 provided on both side wall faces of the insertion hole 33. A light receiver (not shown) within the housing 31 has a plurality of pins 36. The pins 36 extend from the passages 16 on the bottom plate 15 to the outside of the housing 1, thereby fixing or electrically connecting to a circuit board of an electronic device (not shown).

Figure 4:
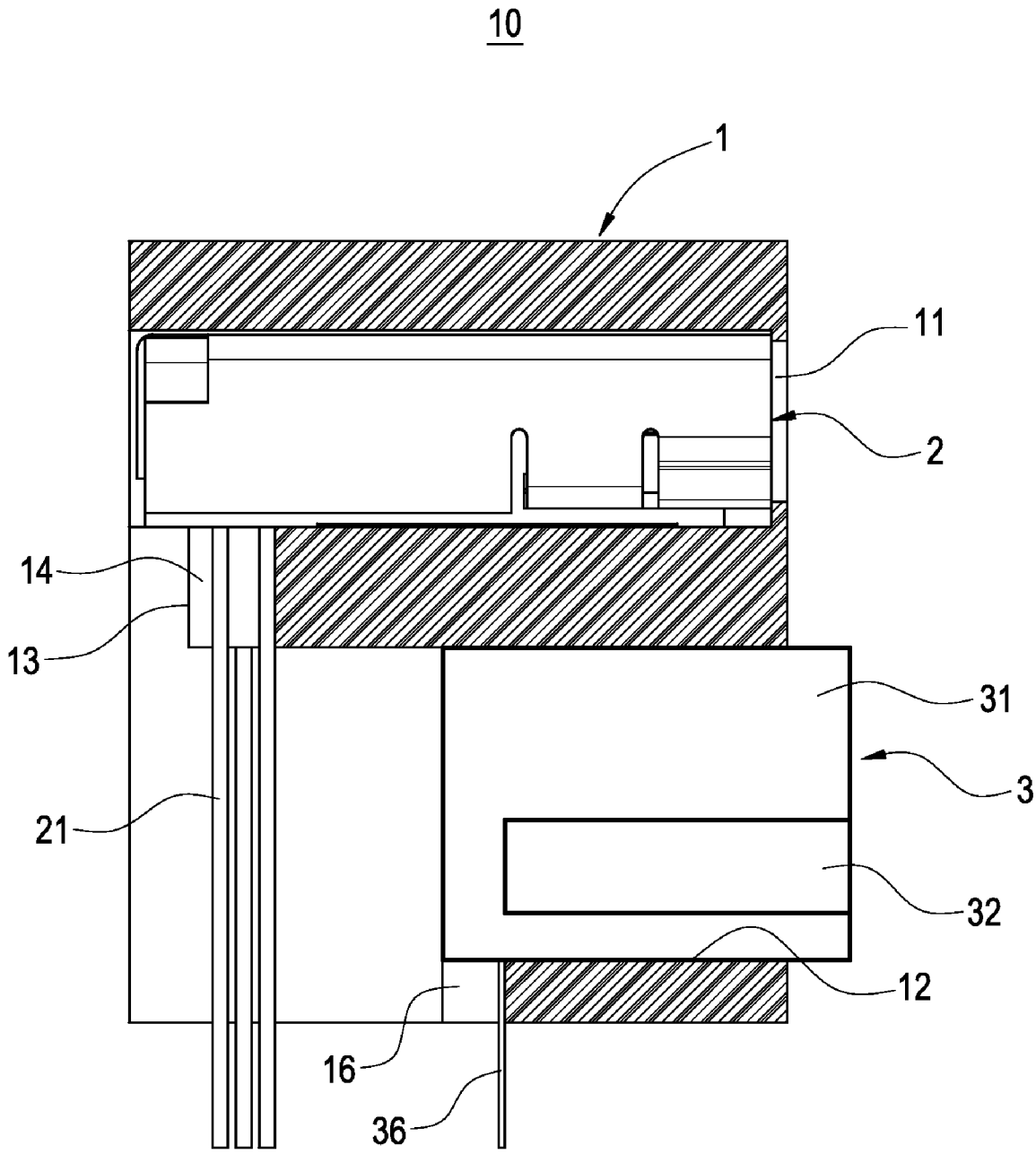
FIG. 4 is a cross-sectional view showing the structure of the multi-port connector according to the present invention.

Please refer to FIG. 4, which is a cross-sectional view showing the multi-port connector of the present invention. As shown in this figure, in mounting the multi-port connector, the HDMI connector 2 is first mounted in the first mounting space 11. The conductive pins 21 of the HDMI connector 2 extend from the grooves 14 through the partition 13 to the outside below the base 1. The SPDIF connector 3 is mounted in the second mounting space 12. The pins 36 of the light receiver within the SPDIF connector 3 pass through the passages 16 of the bottom plate 15 and extend outside the base 1.

Figure 5:
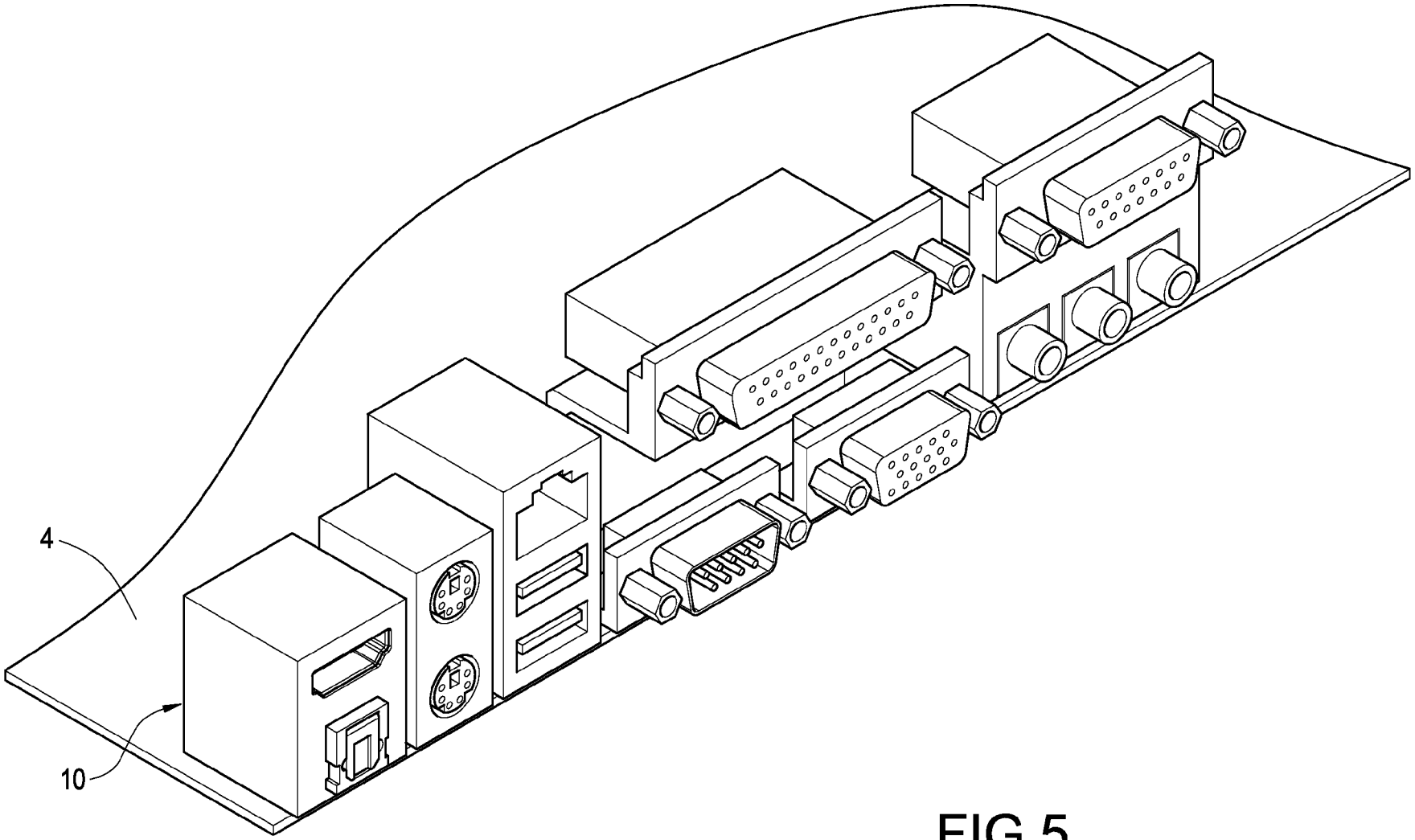
FIG. 5 is a schematic view showing the operating state of the multi-port connector according to the present invention.

Please refer to FIG. 5, which is a schematic view showing the operating state of the multi-port connector according to the present invention. As shown in this figure, after the multi-port connector 10 is electrically connected to the circuit board 4 of the electronic device, the multi-port connector 10 is made to be fixedly connected onto the circuit board 4 of the electronic device. When a user intends to transmit high definition multimedia audio/video signals, the user can insert a plug of a HDMI transmission cable into a HDMI connector 2. If the user intends to transmit the digital audio signals, the user can insert an optical fiber cable into the SPDIF connector 3.

Figure 6:
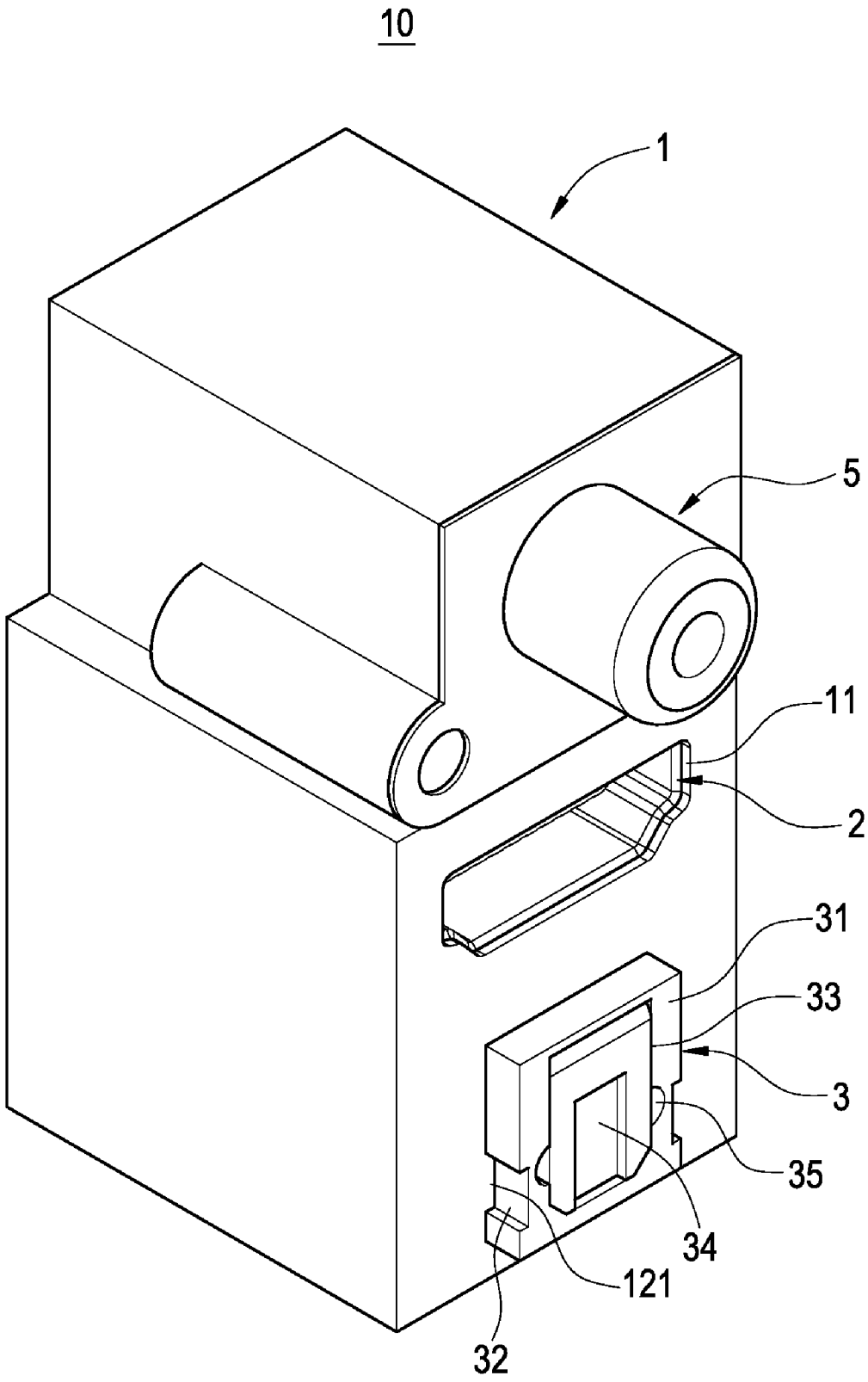
FIG. 6 is a schematic view showing another embodiment of the present invention.

Please refer to FIG. 6, which is a schematic view of another embodiment of the present invention. As shown in this figure, in addition to a HDMI connector 2 and an optical SPDIF connector 3, the multi-port connector 10 of the present invention is further provided with a coaxial SPDIF connector 5, so that the user can insert a coaxial digital transmission line.

Figure 7:
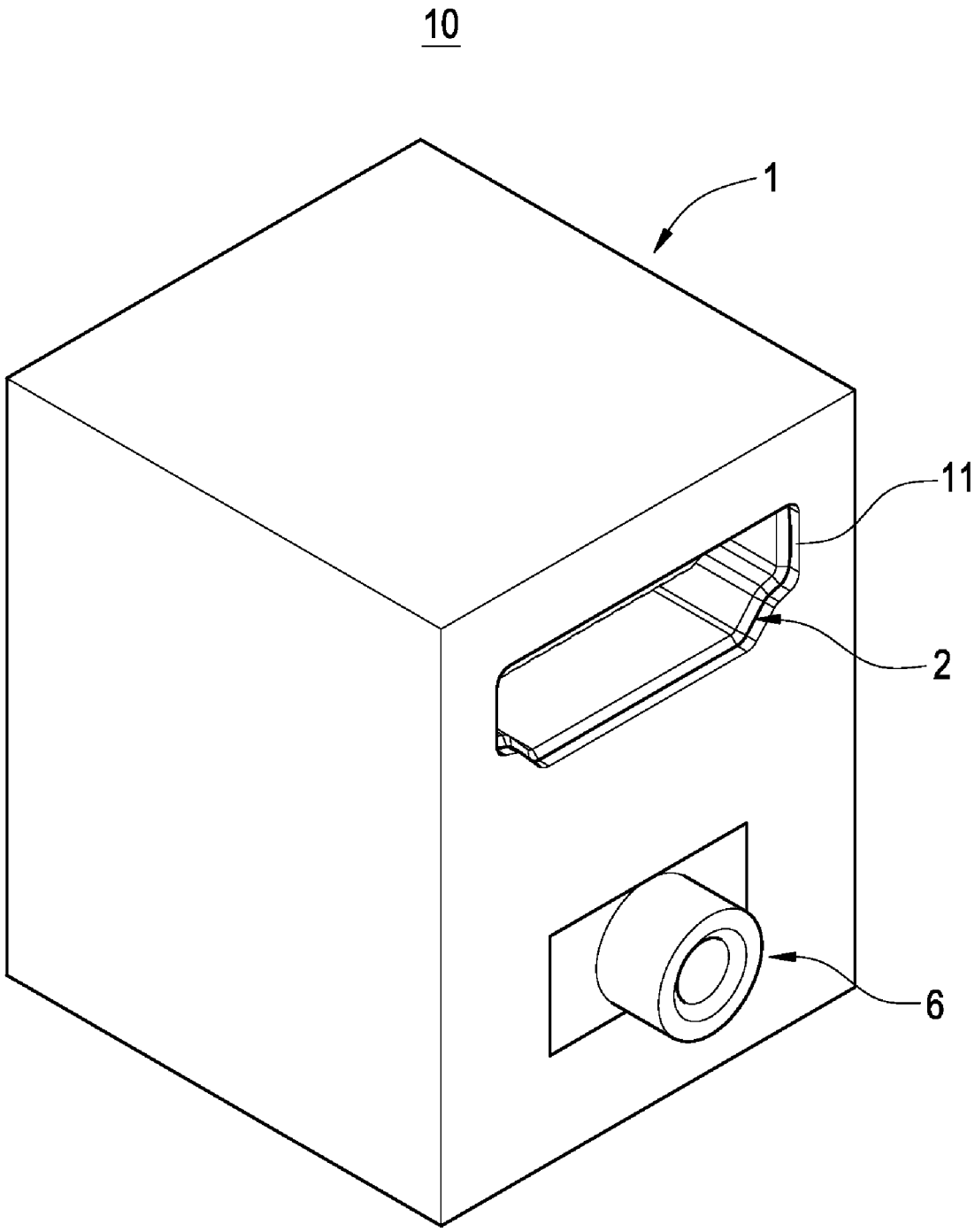
FIG. 7 is a schematic view showing a further embodiment of the present invention.

Please refer to FIG. 7, which is a schematic view showing another embodiment of the present invention. As shown in this figure, the optical SPDIF connector 3 on the multi-port connector 10 can be modified as a Mini Jack SPDIF connector 6, so that the user can insert a pin-type digital transmission line in it.

Figure 8:
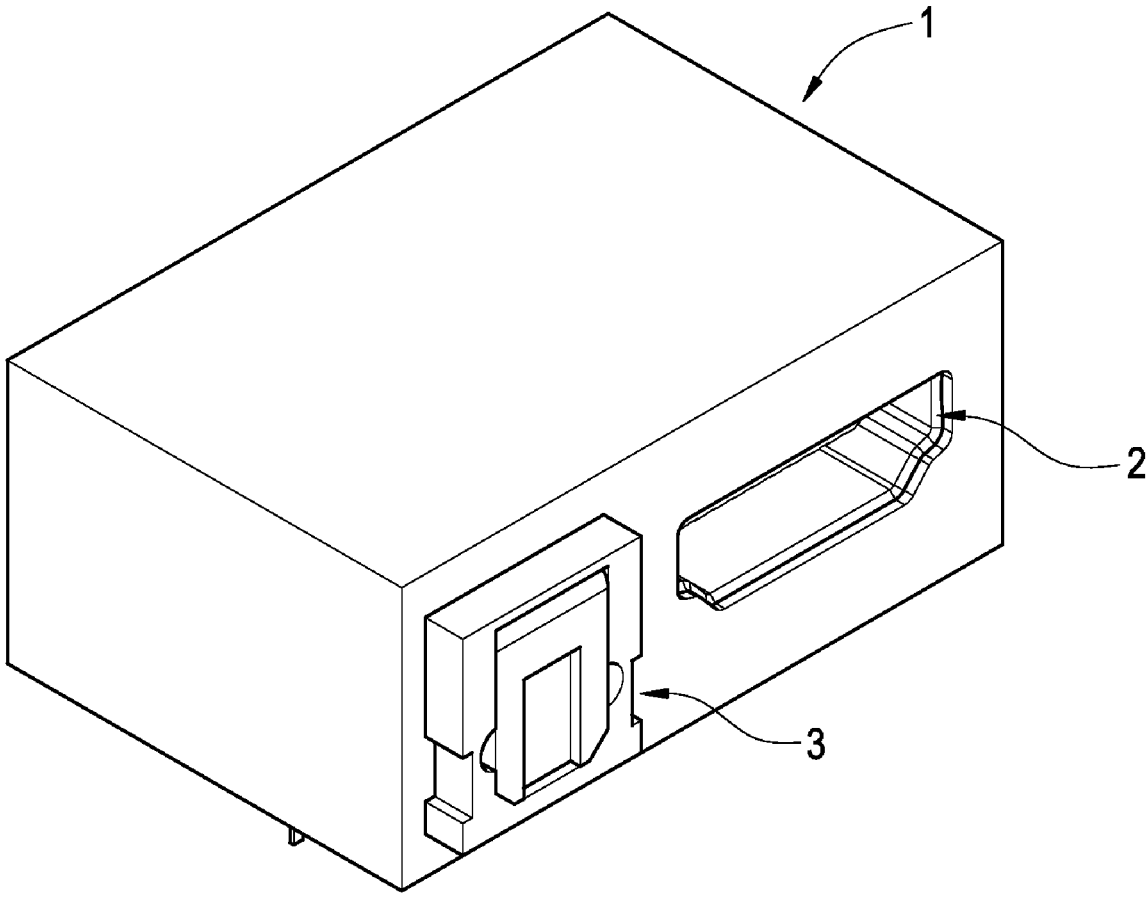
FIG. 8 is a schematic view showing a further embodiment of the present invention.

Please refer to FIG. 8, which is a schematic view showing a further embodiment of the present invention. The HDMI connector 2 and the SPDIF connector 3 can be overlapped or juxtaposed to be assembled together.

The above description is used to explain a preferred embodiment of the present invention, but not used to restrict the scope of the present invention. Equivalent modifications can be still made without departing from the spirit and scope of the present invention. Thus, all such modifications are embraced in the appended claims.

What is claimed is:

1. A multi-port connector of different standards, electrically connected to a circuit board of an electronic device and comprising:

a base having a first mounting space and a second mounting space therein to penetrate the base;

a High Definition Multimedia (HDMI) connector mounted in the first mounting space and having a plurality of totally straight conductive pins directly protruded out from back bottom surface thereof downwardly; and an optical SPDIF connector mounted in the second mounting space and having a plurality of totally straight conductive pins directly protruded out from back bottom portion thereof downwardly, wherein a partition is provided between the first mounting space and the second mounting space, the partition is provided with a plurality of grooves in a first number, and the grooves allow the conductive pins of the HDMI connector to pass through to extend to the outside below the base, wherein the second mounting space is provided with a bottom plate, the bottom plate is provided with a plurality of passages in a second number which is different from the first number, and the passages allow the conductive pins of the SPDIF connector to pass through, wherein the partition is dented from back of the base in a first depth and the bottom plate is dented from back of the base in a second depth which is larger than the first depth so that the conductive pins of the HDMI connector can straightly pass through the grooves without penetrating through the bottom plate, wherein both side wall faces of the second mounting space have two strip-like or sheet-like insertion portions, and wherein the optical SPDIF connector has a housing, both sides of the housing are provided with a trough respectively, the interior of the trough has an insertion hole, the insertion hole is pivotally connected to a movable shutter, and both side wall faces of the insertion hole are provided with guiding rails.

2. The multi-port connector according to claim 1, wherein the base is made of an insulating material.

3. The multi-port connector according to claim 1, further comprising a light receiver in the optical SPDIF connector.

* * * * *